US005156415A

United States Patent [19]

Erdei et al.

[11] Patent Number: 5,156,415

[45] Date of Patent: Oct. 20, 1992

[54] DEVICE FOR THE LONGITUDINAL ADJUSTMENT OF HEEL HOLDERS

[75] Inventors: Roland Erdei, Weigelsdorf; Hubert Wuerthner, Hainburg/Donau, both of Austria

[73] Assignee: TMC Corporation, Baar, Switzerland

[21] Appl. No.: 766,643

[22] Filed: Sep. 25, 1991

[30] Foreign Application Priority Data

Oct. 12, 1990 [AU] Australia ..... 2067/90

[51] Int. Cl.[5] ..... A63C 9/08

[52] U.S. Cl. ..... 280/633; 280/634

[58] Field of Search ..... 280/623, 626, 628, 631, 280/632, 633, 634

[56] References Cited

U.S. PATENT DOCUMENTS 4,589,674 5/1986 Krob et al. ..... 280/633
4,620,719 11/1986 Stritzl ..... 280/633
4,690,424 9/1987 Spitaler et al. ..... 280/633
4,699,398 10/1987 Luschnig et al. ..... 280/633

FOREIGN PATENT DOCUMENTS 375261 12/1980 Austria .
387150 5/1988 Austria .
388877 2/1989 Austria .
390887 1/1990 Austria .

*Primary Examiner*—Andres Kashnikow
*Assistant Examiner*—Richard Camby
*Attorney, Agent, or Firm*—Flynn, Thiel, Boutell & Tanis

[57] ABSTRACT

A device for the longitudinal adjustment of heel holders which includes a guide rail provided with a row of holes, on which guide rail is guided a guide plate carrying the heel holder. Two coil springs are housed in a spring cage and are supported in a recess of the guide plate, of which coil springs at least one coil spring loads the spring cage in direction of a locking member provided with at least one projection. In order to prevent, upon the penetration of snow or dirt into the open areas of the guide plate, the locking member from loosening up and possibly becoming disengaged, the invention provides that the rear crosswall of the spring cage has a bore in the region of the other coil spring, the diameter of which bore is greater than the diameter of the other coil spring so that the latter continuously bears against the locking member.

4 Claims, 3 Drawing Sheets

DEVICE FOR THE LONGITUDINAL ADJUSTMENT OF HEEL HOLDERS

FIELD OF THE INVENTION

The invention relates to a device for the longitudinal adjustment of heel holders.

BACKGROUND OF THE INVENTION

Such a device has already been described in AT-PS 390 887 or AT-PS 388 877. It can happen in these known designs that the heel holder, when snow or dirt penetrates open areas of the guide plate and/or spring cage or cavities or recesses in the guide plate or in the spring cage, can no longer completely slide back into its initial position during the removal of the ski boot from the binding. This, however, has the result that the springs no longer load the locking member, which can then become loose and may possibly unlock.

The purpose of the invention is to overcome this disadvantage and to provide a solution in which the locking member can neither loosen up nor disengage.

SUMMARY OF THE INVENTION

The objects and purposes of the invention are met by providing a device for the longitudinal adjustment of heel holders which includes a guide rail provided with a row of holes, on which guide rail is guided a guide plate carrying the heel holder. Two coil springs are housed in a spring cage and are supported in a recess of the guide plate, of which coil springs at least one coil spring loads the spring cage in direction of a locking member provided with at least one projection. In order to prevent, upon the penetration of snow or dirt into the open areas of the guide plate, the locking member from loosening up and possibly becoming disengaged, the invention provides that the rear crosswall of the spring cage has a bore in the region of the other coil spring, the diameter of which bore is greater than the diameter of the other coil spring so that the latter continuously bears against the locking member. Due to the fact that of the two coil springs one rests at all times on the locking member, the locking member is always held in its locked position and can only voluntarily be disengaged from this position.

The concept of loading the locking member of a device for the longitudinal adjustment of heel holders directly by a spring is actually already known. AT-PS 387 150 describes, for example, a heel holder which is movably guided on a guide rail having a row of holes thereon. It has a locking member which is under the influence of a coil spring, which coil spring urges the locking tooth of the locking member into one of the holes of the row of holes in the guide rail.

The embodiment described in the preceding paragraph belongs to a different class than the subject matter of the invention since no guide plate, no spring cage and only one single spring are provided. Thus, those problems, the solution to which is the purpose of the present invention, can therefore also not occur.

The device described in AT-PS 375 261 for the longitudinal adjustment of ski binding parts is farther removed from the subject matter of the invention since the locking member is constructed as a slide plate with a bolt having to be swivelled by means of a screw driver to lock the plate with respect to the guide rail. Of course, two coil springs, which are supported at their one ends on a guide plate, rest with their other ends directly on the slide plate.

BRIEF DESCRIPTION OF THE DRAWINGS

The drawings show one exemplary embodiment of the invention. More specifically.

DETAILED DESCRIPTION

Figure 1:
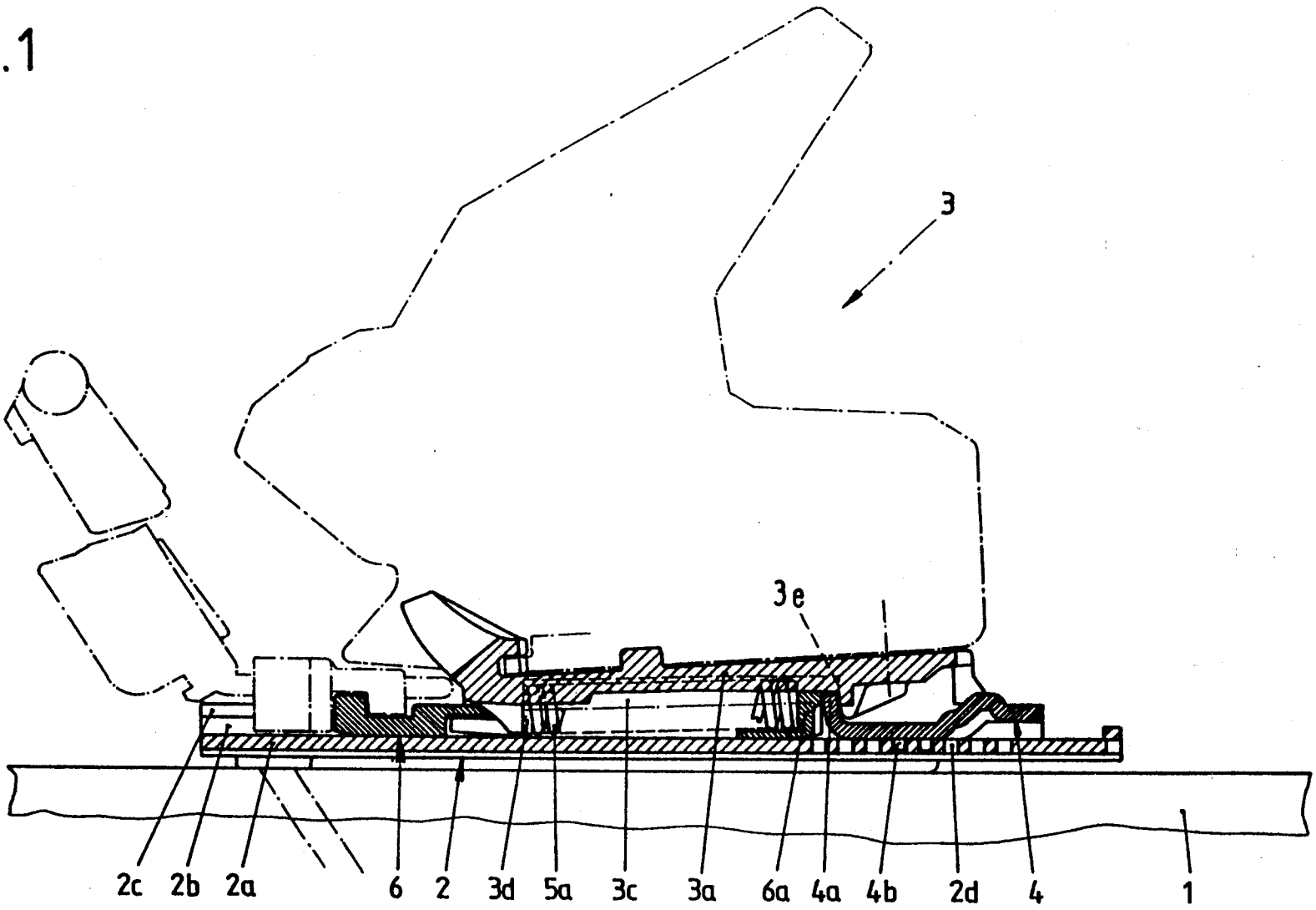
FIG. 1 is a central, vertical longitudinal cross-sectional view of a device embodying the invention in which the heel holder is only schematically indicated.

The device illustrated in FIG. 1 has an upwardly open, U-shaped guide rail 2 fastened with its bight portion or web 2*a*, which web 2*a* has a row of holes 2*d* thereon, to the upper side of a ski 1 by means of screws (not illustrated). A heel holder 3 is mounted on a guide plate 3*a* which is movably guided in a longitudinal direction of the ski 1 on the guide rail 2. The guide plate 3*a* can be fixed in a conventional manner in a plurality of different positions to facile adjustment of the heel holder 3 in the respective desired position, to accommodate ski boots of differing lengths, by means of a locking member 4, which locking member is U-shaped in the side view and engages with two projections 4*b* two holes of the row of holes 2*d*. The two side rails 2*b* of the guide rail 2 have inwardly projecting flanges 2*c* acting as guide bars. The guide plate 3*a* has lateral guide flanges 3*b*, which—viewed in the mounted state of the heel holder 3—are guided between the web 2*a* and the two flanges 2*c* on the guide rail 2.

The guide plate 3*a* has a downwardly and rearwardly open recess 3*c* therein which receives two coil springs 5*a*, 5*b*, which coil springs are housed in a spring cage 6 with one end of each spring being supported on a front, rearwardly facing, boundary wall 3*d* of the recess 3*c*. The guide plate 3*a* together with the heel holder 3 can, with a locking member 4 being fixed on the guide rail 2, be moved toward the end of the ski against the force of the coil springs 5*a*, 5*b* at the time a ski boot is inserted into a ski binding arrangement mounted on the ski 1. The inserted ski boot is thus pressed in a conventional manner with a predetermined force against a front jaw (not shown here).

The one coil spring 5*a* is clamped between the front boundary wall 3*d* of the recess 3*c* in the guide plate 3*a* and a rear, frontwardly facing, transversely extending crosswall 6*a* of the spring cage 6. The other coil spring 5*b* is supported at its one, front, end also on the front boundary wall 3*d* of the recess 3*c*. The other end of the spring 5*b* abuts, through a movable spring plate 7, against the leg 4*a* to load, in the condition illustrated in FIG. 4, also the leg 4*a* of the locking member 4. The leg 4*a* in turn is supported on the rear, frontwardly facing, boundary wall 3*e* of the recess 3*c*. The spring plate 7 extends with sufficient clearance through a bore 6b in the rear crosswall 6a of the spring cage 6.

Figure 5:
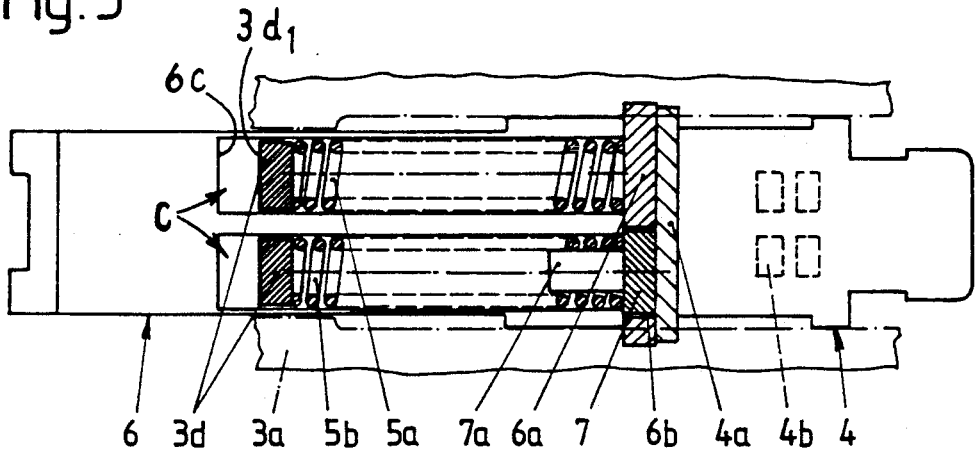

When the ski boot is inserted into the heel holder 3, it is moved together with the guide plate 3a toward the tail end of the ski. Both coil springs 5a, 5b are thereby initially tensioned, with cavities C being formed between the front, frontwardly facing side $3d_1$, of the boundary wall 3d of the guide plate 3a and a front rearwardly facing, crosswall 6c of the spring cage 6 as shown in FIG. 5.

Figure 6:
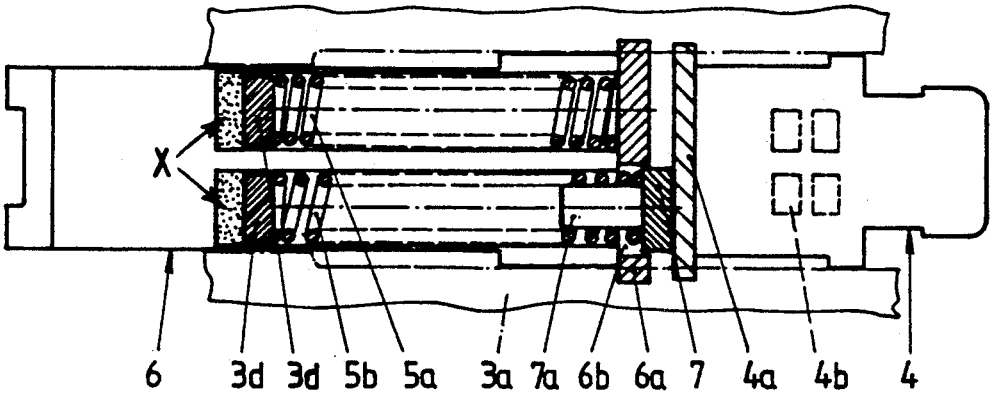

When snow or dirt X settles now in the cavities C as shown in FIG. 6 and when the ski boot is subsequently removed from the binding, then the guide plate 3a and thus the heel holder 3 move in a direction toward the tip of the ski until the snow or dirt is compressed (compare FIG. 6, on the left side). The coil spring 5b urges at the same time, with its other, rear, end, the spring plate 7 rearwardly through the bore 6b in the rear crosswall 6a of the spring cage 6 and thus loads the leg 4a of the locking member 4 so that the locking member 4 cannot automatically disengage from its locked position (see FIG. 6, on the right side).

Figure 2:
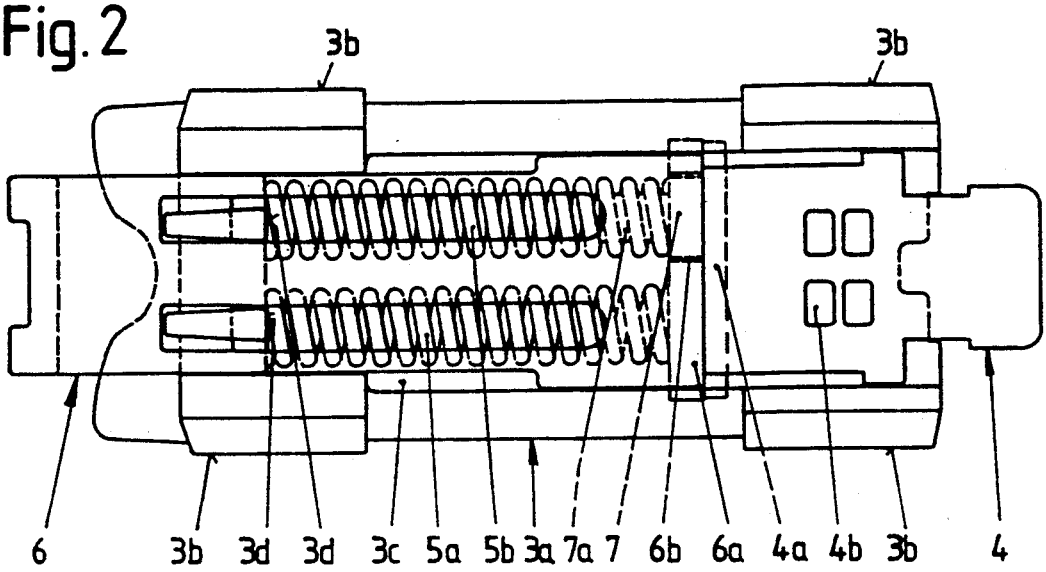
FIG. 2 is a bottom view when the device is in an original initial position.
Figure 4:
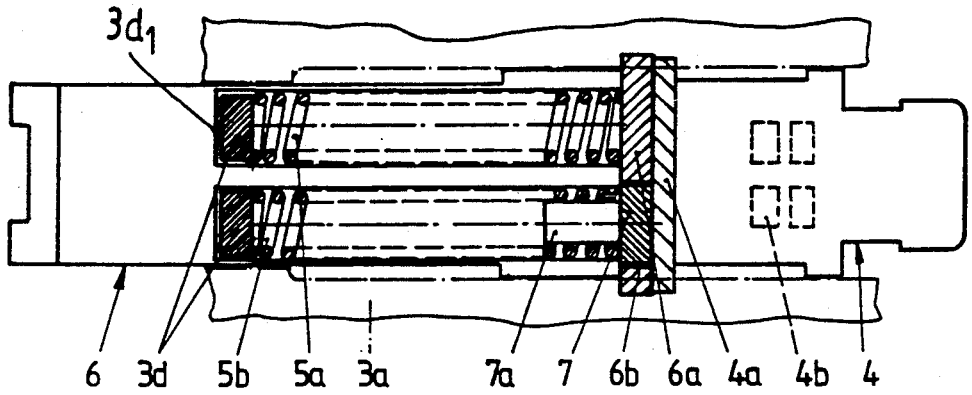
FIGS. 4 to 6 show schematically positions of the device similar to FIGS. 2 and 3, however, viewed from above, FIG. 5 showing a position of the device with the inserted ski boot and without snow or dirt, otherwise as in the illustration of FIGS. 4 and 6.

If no snow or dirt is found in the device, then all movable parts return into the position illustrated in FIG. 4 after the ski boot has been removed (compare also FIGS. 1 and 2).

Also in the case of an extreme bending of the ski, the device of the invention prevents in the case of the existence of snow or dirt an unintended disengaging of the locking member.

Figure 3:
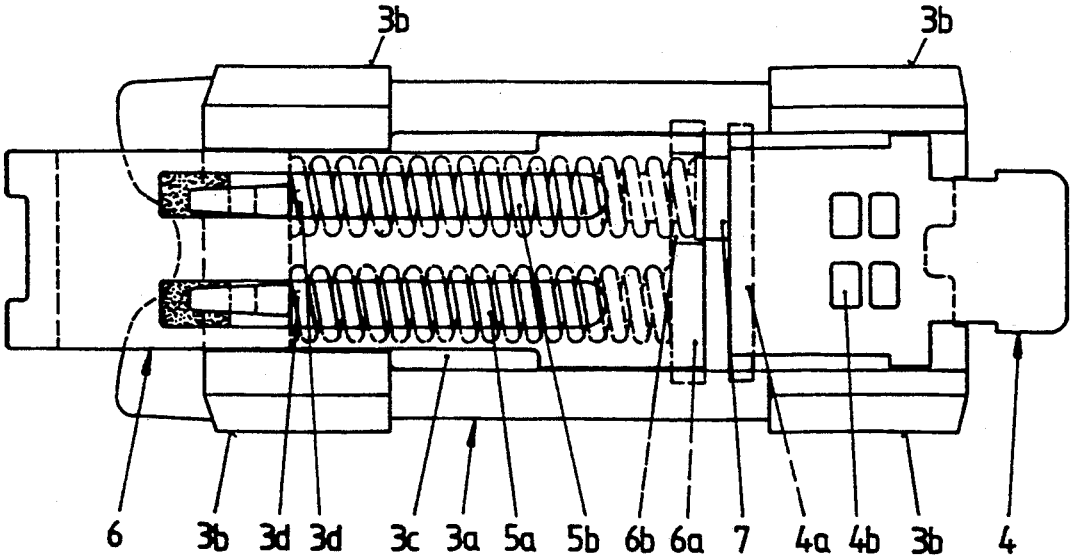
FIG. 3 shows the same view as FIG. 2 and after snow or dirt has penetrated the spring cage and during an attempted return of the heel holder to its original initial position after the ski boot has left the ski binding, but the return is no longer possible.

It would actually be conceivable to let the coil spring 5b rest directly on the locking member 4. This would, however, in order to avoid torques onto the spring cage 6 in a parallel plane to the upper side of the ski 1, require the manufacture of two different coil springs 5a and 5b. In order to now be able to use two springs 5a, 5b with the same effect with the coil spring 5b being supported through the interposed spring plate 7 on the locking member 4, the thickness of the spring plate 7 corresponds with the thickness of the crosswall 6a. In this manner, both coil springs 5a, 5b, if no dirt or snow exists in the spring cage 6, are evenly loaded during operation. If, however, snow or dirt penetrates the spring cage 6 (see FIGS. 3 and 4), then the moment caused by the different initial spring tension is accepted, especially since through this an unintentional release of the locking member 4 is avoided with certainty. The spring plate 7 is, as has already been discussed, guided with sufficient clearance in the bore 6b of the rear crosswall 6a of the spring cage 6. The diameter of the bore 6b is thereby greater than the diameter of the coil spring 5b.

In order to prevent an eccentric positioning of the spring 5b with respect to the spring plate 7 during operation, the spring plate 7 has a centering shoulder 7a guided into the coil spring 5b. The diameter of the centering shoulder 7a is thereby dimensioned corresponding with the inside diameter of the coil spring 5b.

Figure 7:
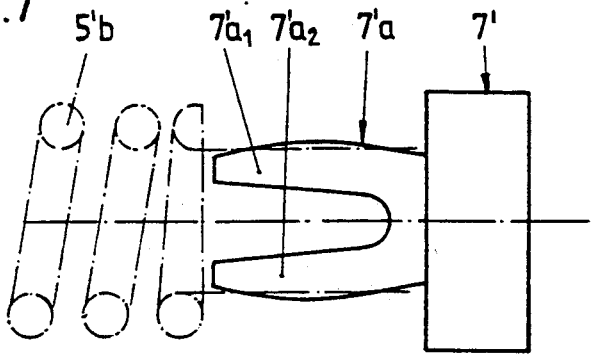
FIG. 7 illustrates a modification of the centering shoulder.

The shoulder is constructed as a fork in the modification of the centering shoulder 7'a of the spring plate 7' illustrated in FIG. 7. The two prongs $7'a_1$, $7'a_2$ of the fork are resiliently outwardly initially tensioned. The maximum distance between the two prongs $7'a_1$, $7'a_2$ is thereby in the unassembled condition greater than the inside diameter of the coil spring 5'b. The outer boundary surfaces of the two prongs $7'a_1$, $7'a_2$, viewed from the axis of the coil spring 5'b, are furthermore convexly curved, which makes the assembly of the spring plate 7' with the centering shoulder 7'a and of the coil spring 5'b easier.

The invention is not to be limited to the above-described exemplary embodiment illustrated in the drawings. Rather various modifications of same are possible without departing from the scope of the invention. For example, the invention includes an embodiment in which the bore 6b in the rear crosswall 6a of the spring cage 6 is designed conically in contrast to the illustrated cylindrical embodiment in order to make the return of the spring plate 7 into the inside of the spring cage 6 easier. It is furthermore possible to provide the locking member with several tooth-like designed projections, which then, in the engaged condition of the locking member, extend into tooth gaps of oppositely lying serrated slats of the guide rail.

The embodiments of the invention in which an exclusive property or privilege is claimed are defined as follows:

1. In a device for the longitudinal adjustment of a heel holder comprising a guide rail adapted to be fastened to a ski, said guide rail having two flanges acting as guide bars, said guide rail having at least one of a row of holes and a row of teeth therein extending in a longitudinal direction of the device, on which guide rail is guided for longitudinal movement a guide plate carrying the heel holder, said guide plate having a downwardly open recess opening into a spring cage having a rear crosswall, first and second coil springs in the recess, one end of each of said first and second springs being supported on a front boundary wall of the recess with said first coil spring being supported at its opposite end on the rear crosswall of the spring cage, a locking member having at least one projection being operatively associated with the guide rail, said locking member, when viewed from the side, having a generally upwardly open U-shaped design and rests with one leg on a rear boundary wall of the recess, said projection extending into at least one of a selected one of said holes and a selected one of a tooth gap between said teeth, the improvement wherein the rear crosswall of the spring cage has an opening therethrough in the region of said second coil spring, the diameter of said opening being greater than the diameter of said second coil spring so that said second coil spring extends through said opening to be continuously supported on said one leg of said locking member.

2. The device according to claim 1, wherein between the locking member and said second coil spring there is provided a spring plate guided in said opening and having a thickness corresponding with the thickness of the rear crosswall of the spring cage.

3. The device according to claim 2, wherein the spring plate has a centering shoulder which projects in the direction of the axis of said second coil spring into said second coil spring, an outside diameter of said centering shoulder conforming with an inside diameter of said second coil spring.

4. The device according to claim 2, wherein the spring plate has a centering shoulder in a form of a fork having at least two prongs, said prongs being outwardly resilient, wherein outer boundary surfaces of said prongs, when viewed from the axis of said second coil spring, are convexly curved, and wherein the maximum distance between said at least two prongs is greater in the unassembled condition of the centering shoulder than the inside diameter of said second coil spring.

* * * * *